US009790768B2

(12) United States Patent
Gregurek et al.

(10) Patent No.: US 9,790,768 B2
(45) Date of Patent: Oct. 17, 2017

(54) APPARATUS TO ACTIVATE A DOWNHOLE TOOL BY WAY OF ELECTROMAGNETS VIA WIRELINE CURRENT

(71) Applicants: Philip M. Gregurek, Pearland, TX (US); Antonio C. Ruffo, Cypress, TX (US)

(72) Inventors: Philip M. Gregurek, Pearland, TX (US); Antonio C. Ruffo, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/800,158

(22) Filed: Jul. 15, 2015

(65) Prior Publication Data

US 2017/0016306 A1 Jan. 19, 2017

(51) Int. Cl.
*E21B 41/00* (2006.01)
*E21B 23/00* (2006.01)

(52) U.S. Cl.
CPC ..... *E21B 41/00* (2013.01); *E21B 23/00* (2013.01)

(58) Field of Classification Search
CPC ..... E21B 23/00; E21B 34/006; E21B 41/00; H01F 7/04
See application file for complete search history.

(56) References Cited

U.S. PATENT DOCUMENTS 5,236,047 A * 8/1993 Pringle ..... E21B 17/06 166/369
8,627,883 B2 * 1/2014 Richards ..... E21B 34/066 137/870
8,893,807 B2 * 11/2014 Tait ..... E21B 23/00 166/208
2010/0059233 A1 * 3/2010 Smithson ..... E21B 23/00 166/385
2011/0120727 A1 * 5/2011 Lake ..... E21B 34/066 166/375
2012/0234530 A1 * 9/2012 Tait ..... E21B 41/00 166/66.5
2014/0338924 A1 * 11/2014 Wilson ..... E21B 34/066 166/381

* cited by examiner

*Primary Examiner* — James G Sayre
(74) *Attorney, Agent, or Firm* — Cantor Colburn LLP

(57) ABSTRACT

An apparatus and method for activating a downhole tool of a production system is disclosed. The apparatus includes a first component, a first magnetic member coupled to the first component, a second component of movable with respect to the first component, and a second magnetic member attached to the second component. The first component is generally stationary with respect a work string of the production system. An electric current activates at least one of the first magnetic member and the second magnetic member to create a magnetic force between the first magnetic member and the second magnetic member, thereby moving the movable component with respect to the stationary component to perform the action downhole. The produced motion of the movable component activates the downhole tool.

20 Claims, 2 Drawing Sheets

APPARATUS TO ACTIVATE A DOWNHOLE TOOL BY WAY OF ELECTROMAGNETS VIA WIRELINE CURRENT

BACKGROUND OF THE DISCLOSURE

1. Field of the Disclosure

The present disclosure provides a method and apparatus for performing an operation downhole and, in particular, to electromagnetically moving a component downhole in order to activate a downhole tool.

2. Description of the Related Art

In productions systems, as well as other downhole systems, it is generally desired to convey a tool to a downhole location on a work string and to activate the downhole tool once it is in place downhole. To activate the downhole tool, a component or part is physically moved downhole. Generally, the force required to move such parts is large, requiring large activation devices to being conveyed downhole along with the downhole tool. Conveying such large devices can be both expensive and cumbersome.

SUMMARY OF THE DISCLOSURE

In one aspect of the present disclosure, a method of activating a downhole tool is provided, including: conveying an actuator to a location of the downhole tool, wherein the actuator includes a stationary component having a first magnetic member affixed thereto and a movable component with respect to the stationary component, the movable component having a second magnetic member affixed thereto; and activating at least one of the first magnetic member and the second magnetic member to create a magnetic force between the first magnetic member and the second magnetic member to move the movable component, wherein motion of the movable component activates the downhole tool.

In another aspect of the present disclosure, an apparatus for performing an operation downhole is provided, the apparatus including: a first component; a first magnetic member coupled to the first component; a second component movable with respect to the first component; a second magnetic member attached to the second component; and a power supply configured to activate at least one of the first magnetic member and the second magnetic member to create a magnetic force between the first magnetic member and the second magnetic member that moves the movable component with respect to the stationary component to perform the action downhole.

In yet another aspect of the present disclosure, a production system is provided, the production system including: a first component that is stationary with respect to a section of a work string, the first component having a first magnetic member; a second component movable with respect to the first component and having a second magnetic member; a tool connected to the movable component that is activated by motion of the second component; and a power supply for activating at least one of the first magnetic member and the second magnetic member to create a magnetic force between the first magnetic member and the second magnetic member for moving the movable component with respect to the stationary component to activate the downhole tool.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
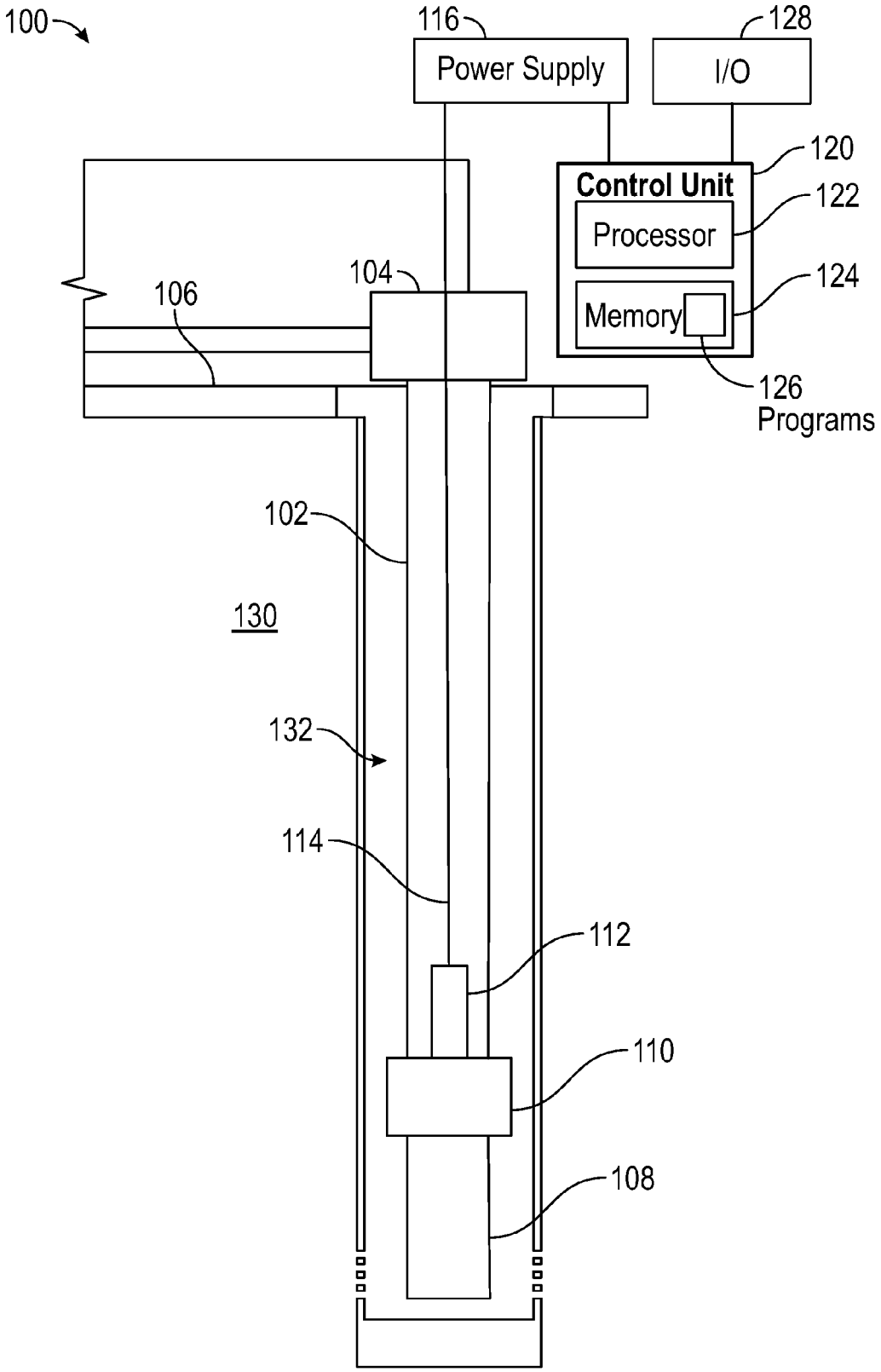
FIG. 1 shows an exemplary production system of the present disclosure that includes a downhole apparatus suitable for control of an operation downhole.

FIG. 1 shows an exemplary production system 100 of the present disclosure that includes a downhole apparatus suitable for control of an operation downhole which can be activated or actuated using the methods disclosed herein. The production system 100 includes a work string 102 disposed in a wellbore 132 formed in a formation 130. The work string 102 extends in the wellbore 132 from a wellhead 104 at a surface location 106 to a downhole location 108. In various embodiments, the work string 102 may include a drill string, a production string, a fracturing system including a multi-stage fracturing system, a perforation string, or other suitable work string. A tool 110 for performing a downhole operation is conveyed to a selected depth of the wellbore by the work string 102. The tool 110 may be a bridge plug, a packer, an electrical submersible pump (ESP), a flow control device such as a valve, sleeve, piston or switch, a pneumatic cylinder control, a fracturing tool, or other suitable downhole device that is to be actuated at its downhole location. An actuation device or actuator 112 (described in further detail with respect to FIGS. 2 and 3) may be connected to the downhole tool 110. The actuation device 112 is coupled to a power supply 126-116 (which may be at the surface location 106) via cable 114 and receives electrical power and current from the power supply 116. Control unit 120 controls the power supply 116 to selectively provide current to the actuation device 112 to thereby actuate the downhole tool 110 as described herein.

In an exemplary embodiment, the control unit 120 may be at a surface location 106. However, the control unit 120 and power supply 116 may be located at a suitable location in the work string 102 in alternate embodiments. The control unit 120 includes a processor 122, a memory location or memory storage device 124 and one or more programs 126 stored in the memory storage device 124 for operation of the actuator 112 and/or downhole tool 110. The memory storage device 124 may be any suitable non-transitory storage medium such as a solid-state memory device, etc. When accessed by the processor 122, the one or more programs 126 enable the processor 122 to perform the methods disclosed herein for controlling operation of the actuation device 112 and/or downhole tool 110. An input/output system 128 such as a keyboard, mouse and display or monitor allows an operator to communicate with the control unit 120 to control the downhole tool 110.

Figure 2:
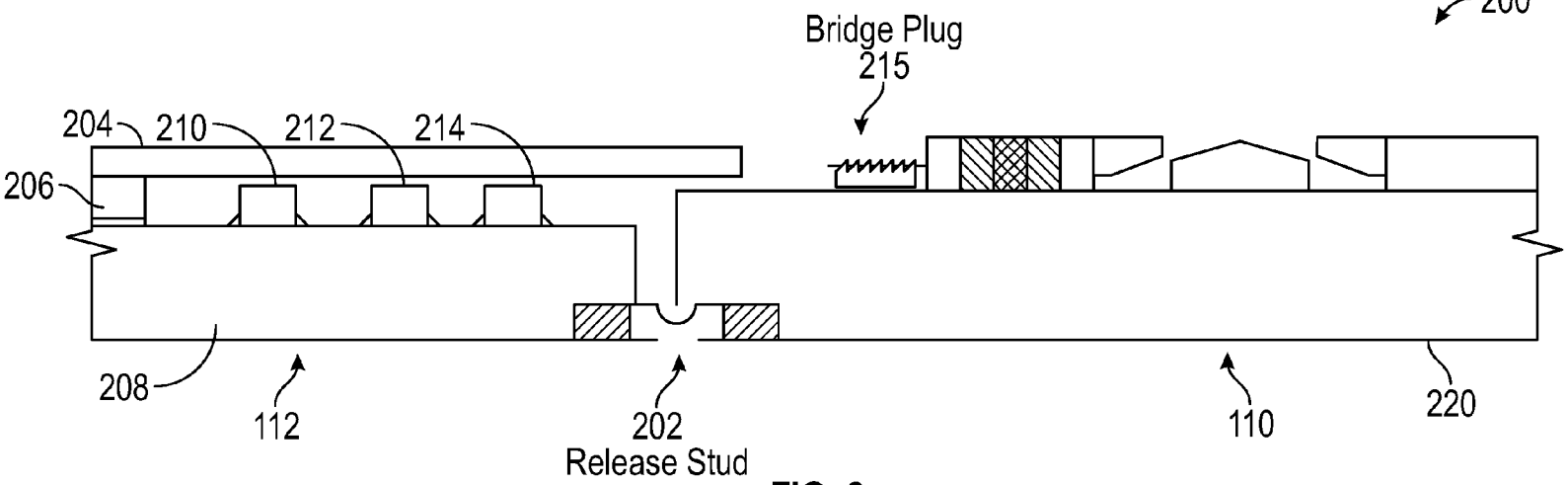
FIGS. 2 and 3 show a downhole activation device of a work string of the exemplary production system in various modes of operation.
Figure 3:
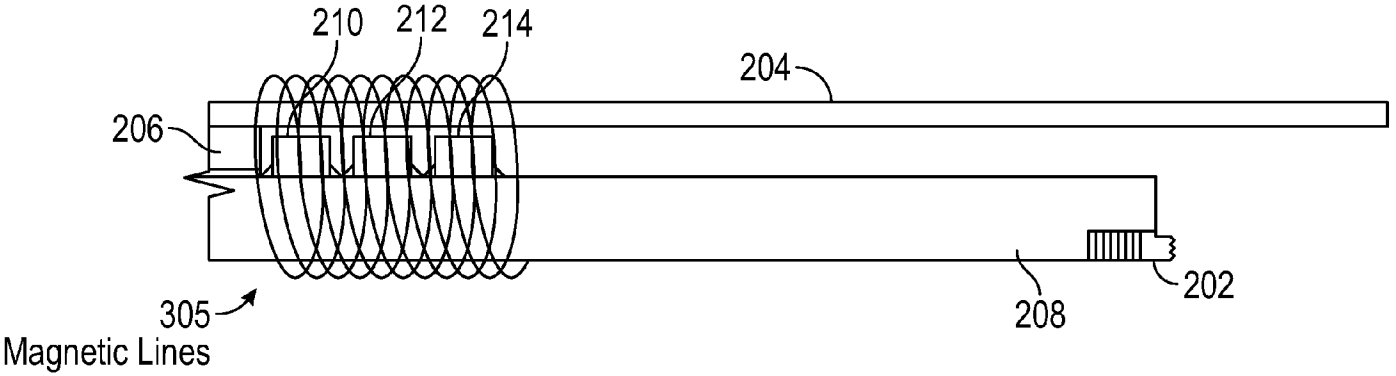

FIGS. 2 and 3 show a downhole section 200 of the work string 102 in various modes of operation of the actuation device 112 of the present disclosure. The exemplary downhole section 200 shows a longitudinal axis 220 of the work string 102, the downhole tool 110, and the actuation device 112. The actuation device 112 is shown uphole of the downhole tool 110. However any arrangement of the actuation device 112 and the downhole tool 110 along the work string 102 is possible in alternate embodiments of the present disclosure. As shown in the illustrative embodiment of FIG. 2 the actuator 112 is mechanically coupled to the downhole tool 110 via a release stud 202. The actuator 112 is generally conveyed downhole along with the downhole tool 110.

The actuation device 112 includes a stationary component 204 and a movable component 208 that is movable with respect to the stationary component 208. In one embodiment, the stationary component 204 includes a setting tool which may take the form of a tubular sleeve. The movable component 208 moves within the tubular sleeve defined by the setting tool. In general, the stationary component 208 moves along the longitudinal axis 220.

The stationary component 204 includes a first magnetic member 206 attached, affixed or mechanically coupled to the stationary component 204. In one embodiment, the first magnetic member 206 is attached to an inner wall of the stationary component 204. The first magnetic member 206 is generally an electromagnet that can be switched between an inert ("off") state and an active ("on") state. In an alternate embodiment, the first magnetic member 206 is a permanent magnet.

The movable component 208 includes one or more second magnetic members 210, 212, 214 attached, affixed or mechanically coupled to the movable component 208. The one or more second magnetic members 210, 212, 214 may include a single magnetic member (e.g., magnetic member 210) in alternate embodiments. The second magnetic members 210, 212 and 214 may be electromagnets that can be placed in an inert state or active state. In general, the second magnetic members 210, 212 and 214 and the first magnetic member 208 are either both in the active state or both in the inert state.

In the inert state (FIG. 2), no current is flowing through the first magnetic member 206 and the second magnetic members 210, 212, 214. Therefore no magnetic fields and no magnetic forces are produced between the first magnetic member 206 and the second magnetic member 210, 212, 214. In the active state (FIG. 3), electric currents are sent through the first magnetic member 206 and the second magnetic members 210, 212, 214 so that the first magnetic member 206 and the second magnetic members 210, 212, 214 produce magnetic fields. These magnetic fields are aligned so as to produce a magnetic force, either attractive or repulsive, in order to cause the movable component 206 to move with respect to the stationary component 204.

In one embodiment, the first magnetic member 206 is arranged so that the magnetic field lines 305 produced by the first magnetic member 206 and the magnetic field lines 305 produced by the second magnetic members 210, 212, 214 are oriented along the longitudinal axis 220 of the work string 102. If the magnetic field lines 305 of the second magnetic members 210, 212, 214 are parallel to the magnetic field lines 305 of the first magnetic member 206, the second magnetic members 210, 212, 214 are attracted to the first magnetic member 206, thereby moving the movable component 208 uphole. If the magnetic field lines 305 of the second magnetic members 210, 212, 214 are anti-parallel to the magnetic field lines 305 of the first magnetic member 206, the second magnetic members 210, 212, 214 are repelled by the first magnetic member 206, thereby moving the movable component 208 downhole.

Alternatively, the first member 206 and second members 210, 212, 214 may produce magnetic fields that are oriented transverse to the longitudinal axis 220. If the magnetic field lines 305 of the second magnetic members 210, 212, 214 are anti-parallel to the magnetic field lines 305 of the first magnetic member 206, the second magnetic members 210, 212, 214 are attracted to the first magnetic member 206. If the magnetic field lines 305 of the second magnetic members 210, 212, 214 are parallel to the magnetic field lines 305 of the first magnetic member 206, the second magnetic members 210, 212, 214 are repelled by the first magnetic member 206.

FIG. 3 shows the movable component 208 having moved uphole to break the release stud 202 to separate the downhole tool 110 from the work string 102. In order to break the release stud 202, a bridge plug 215 is activated to anchor the downhole tool 110 against a stationary support, such as a section of a downhole casing or against a wall of the wellbore. Once the downhole tool 110 is anchored, the first magnetic 206 member and the second magnetic members 210, 212, 214 are activated to create a longitudinal movement in the movable component 208. Movement of the movable component 208 creates a tensile force on the release stud 202 to break the release stud 202.

As shown in FIG. 3, the second magnetic members 210, 212, 214 may be attracted to each other as well as to the first magnetic member 208. Thus, the second magnetic members 210, 212 and 214 may be located on separate movable components that are capable of moving with respect to each other in at least the longitudinal direction. In alternative embodiments, the motion of the movable component 208 may pull a switch in the downhole tool 110 to activate the downhole tool 110 or a sub-section of the downhole tool 110. Alternatively, the movable component 208 may move a lever or other mechanical component of the downhole tool 110. Other possible downhole actions may include, for example, setting a packer, setting a bridge plug; releasing an item downhole, disengaging a locking ring of the downhole tool, retrieving a downhole tool, etc. The movable component 208 may be moved uphole and downhole various times during operation of the downhole tool 110 to selectively activate and de-activate the downhole tool 110 by flipping a switch, for example.

Therefore, in one aspect, the present disclosure provides a method of activating a downhole tool is provided, including: conveying an actuator to a location of the downhole tool, wherein the actuator includes a stationary component having a first magnetic member affixed thereto and a movable component with respect to the stationary component, the movable component having a second magnetic member affixed thereto; and activating at least one of the first magnetic member and the second magnetic member to create a magnetic force between the first magnetic member and the second magnetic member to move the movable component, wherein motion of the movable component activates the downhole tool. Activating the at least one of the first magnetic member and the second magnetic member may include supplying a current from a power supply at a surface location to the at least one of the first magnetic member and the second magnetic member. In one embodiment, the first magnetic member includes a first electromagnetic and/or a permanent magnet. Additionally, the second magnetic member may be a second electromagnet. The stationary component may be an outer sleeve of a work string and the movable component may be an inner sleeve of the work string. In one embodiment, the movable component moves along a longitudinal axis of the work string to activate the downhole tool. Magnetic fields produced by the first magnetic member and the second magnetic member may be at least one of: (i) oriented along the longitudinal axis of the work string and parallel to each other; (ii) oriented along the longitudinal axis of the work string and anti-parallel to each other; (iii) oriented transverse to the longitudinal axis of the work string and parallel to each other; and (iv) oriented transverse to the longitudinal axis of the work string and anti-parallel to each other. The movable component moves to perform at least one of the following: (i) break a release stud of the downhole tool; (ii) set a packer; (iii) set a bridge plug; (iv) release an item downhole; (v) disengage a locking ring of the downhole tool; (vi) perform a frac operation; (vii) pull a lever; (vii) flip a switch of the downhole tool; and (ix) retrieve a downhole tool.

In another aspect, the present disclosure provides an apparatus for performing an operation downhole, including: a first component; a first magnetic member coupled to the first component; a second component movable with respect to the first component; a second magnetic member attached to the second component; and a power supply configured to activate at least one of the first magnetic member and the second magnetic member to create a magnetic force between the first magnetic member and the second magnetic member that moves the movable component with respect to the stationary component to perform the action downhole. The first component and second component are conveyed downhole on a work string and the first component is stationary with respect to the work string. The power supply may be located at a surface location and provides a current from the surface location to the first magnetic member and the second magnetic member along a wireline. The second magnetic member may be an electromagnet. Additionally, first magnetic member may be either an electromagnetic or a permanent magnet.

In yet another aspect, the present disclosure provides a production system, including: a first component that is stationary with respect to a section of a work string, the first component having a first magnetic member; a second component movable with respect to the first component and having a second magnetic member; a tool connected to the movable component that is activated by motion of the second component; and a power supply for activating at least one of the first magnetic member and the second magnetic member to create a magnetic force between the first magnetic member and the second magnetic member for moving the movable component with respect to the stationary component to activate the downhole tool. The power supply may be located at a surface location and provides a current to at least one of the first magnetic member and the second magnetic member along a wireline. The second magnetic member may include an electromagnet, and the first magnetic member may include either an electromagnetic or a permanent magnet. In one embodiment, the movable component moves along a longitudinal axis of the production system.

Examples of certain features of the apparatus and method disclosed herein are summarized rather broadly in order that the detailed description thereof that follows may be better understood. There are, of course, additional features of the apparatus and method disclosed hereinafter that will form the subject of the claims. While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. A method of setting a downhole tool in a wellbore, comprising:

conveying an actuator and the downhole tool to a location in the wellbore with the actuator longitudinally separated from the downhole tool, wherein the actuator includes a stationary component having a first magnetic member coupled thereto and a movable component with respect to the stationary component, wherein the movable component has a second magnetic member coupled thereto and is coupled to the downhole tool via a release stud;

setting a bridge plug of the downhole tool; and activating at least one of the first magnetic member and the second magnetic member to create a magnetic force between the first magnetic member and the second magnetic member, wherein the magnetic force moves the movable component longitudinally, wherein longitudinal motion of the movable component from the magnetic force breaks the release stud to separate the actuator from the downhole tool.

2. The method of claim 1, wherein activating the at least one of the first magnetic member and the second magnetic member further comprises supplying a current from a power supply at a surface location to the at least one of the first magnetic member and the second magnetic member.

3. The method of claim 1, wherein the first magnetic member is one of: (i) a first electromagnetic; and (ii) a permanent magnet.

4. The method of claim 3, wherein the second magnetic member includes a second electromagnet.

5. The method of claim 1, further comprising moving the movable component to perform at least one of the following: (i) set a packer; (ii) release an item downhole; (iii) disengage a locking ring of the downhole tool; (iv) perform a frac operation; (v) pull a lever; (vi) flip a switch of the downhole tool; and (vii) retrieve a downhole tool.

6. The method of claim 1, wherein the stationary component is an outer sleeve of a work string and the movable component is an inner sleeve of the work string.

7. The method of claim 6, wherein the movable component moves along a longitudinal axis of the work string to break the stud.

8. The method of claim 1, wherein magnetic fields produced by the first magnetic member and the second magnetic member are at least one of: (i) oriented along the longitudinal axis of the work string and parallel to each other; (ii) oriented along the longitudinal axis of the work string and anti-parallel to each other; (iii) oriented transverse to the longitudinal axis of the work string and parallel to each other; and (iv) oriented transverse to the longitudinal axis of the work string and anti-parallel to each other.

9. An apparatus for performing an operation downhole, comprising:

a downhole tool having a bridge plug;

a first component uphole of the downhole tool;

a first magnetic member coupled to the first component;

a second component movable with respect to the first component and coupled to the downhole tool by a release stud;

a second magnetic member coupled to the second component; and a power supply configured to activate at least one of the first magnetic member and the second magnetic member to create a magnetic force between the first magnetic member and the second magnetic member that moves the movable component longitudinally with respect to the stationary component to perform the action downhole, wherein longitudinal motion of the movable component from the magnetic force breaks the release stud to separate the second component from the downhole tool.

10. The apparatus of claim 9, wherein the first component and second component are conveyed downhole on a work string and the first component is stationary with respect to the work string.

11. The apparatus of claim 9, wherein the power supply is located at a surface location and provides a current from the surface location to the first magnetic member and the second magnetic member along a wireline.

12. The apparatus of claim 9, wherein the second magnetic member includes an electromagnet.

13. The apparatus of claim 12, wherein the first magnetic member is one of: (i) an electromagnetic; and (ii) a permanent magnet.

14. The apparatus of claim 9, further comprising moving the movable component to perform at least one of the following: (i) set a packer; (ii) release an item downhole; (iii) disengage a locking ring of the downhole tool; (iv) perform a frac operation; (v) pull a lever; (vi) flip a switch of the downhole tool; and (vii) retrieve a downhole tool.

15. The production system of claim 14, wherein the movable component moves along a longitudinal axis of the production system.

16. A production system, comprising:

a first component that is stationary with respect to section of a work string, the first component having a first magnetic member;

a second component movable with respect to the first component and having a second magnetic member;

a tool connected to the movable component via a release stud; and a power supply for activating at least one of the first magnetic member and the second magnetic member to create a magnetic force between the first magnetic member and the second magnetic member for moving the movable component longitudinally with respect to the stationary component, wherein longitudinal motion of the movable component from the magnetic force breaks the release stud to separate the movable component from the tool.

17. The production system of claim 16, wherein the power supply is located at a surface location and provides a current to at least one of the first magnetic member and the second magnetic member along a wireline.

18. The production system of claim 16, wherein the second magnetic member includes an electromagnet.

19. The production system of claim 18, wherein the first magnetic member is one of: (i) an electromagnetic; and (ii) a permanent magnet.

20. The production system of claim 16, wherein the movable component moves to perform at least one of the following: (i) set a packer; (ii) release an item downhole; (iii) disengage a locking ring of the downhole tool; (iv) perform a frac operation; (v) pull a lever; (vi) flip a switch of the downhole tool; and (vii) retrieve a downhole tool.

* * * * *